US005769733A

United States Patent [19]

Williams et al.

[11] Patent Number: 5,769,733

[45] Date of Patent: Jun. 23, 1998

[54] METHOD FOR BALANCING A SET OF GOLF CLUBS

[76] Inventors: Stan A. Williams, 1216 Scholl Rd., Ames, Iowa 50014; Tae N. Kim, 220 S. 28th St., West Des Moines, Iowa 50266

[21] Appl. No.: 636,045

[22] Filed: Apr. 22, 1996

[51] Int. Cl.[6] ..... A63B 53/00

[52] U.S. Cl. ..... 473/291; 473/297; 473/409

[58] Field of Search ..... 473/287, 291, 473/292, 297, 409

[56] References Cited

U.S. PATENT DOCUMENTS

| | | | |
|---|---|---|---|
| 3,473,370 | 10/1969 | Marciniak | 73/65.03 |
| 3,606,327 | 9/1971 | Gorman | 473/337 |
| 3,698,239 | 10/1972 | Everett, III | 73/65.03 |
| 3,703,824 | 11/1972 | Osborne et al. | 73/65.03 |
| 4,059,270 | 11/1977 | Sayers | 473/409 |
| 4,128,242 | 12/1978 | Elriuns | 473/291 |
| 4,375,887 | 3/1983 | Lynch et al. | 473/409 |
| 5,106,087 | 4/1992 | Simmons | 473/287 |
| 5,118,102 | 6/1992 | Bahill et al. | 273/25 |
| 5,245,537 | 9/1993 | Barber | 364/410 |

OTHER PUBLICATIONS

"On the Dynamics of the Swing of a Golf Club", American Journal of Physics, Theodore Jorgensen, Jr., vol. 38, No. 5, May 1970, pp. 644–651.

*Primary Examiner*—Sebastiano Passaniti
*Assistant Examiner*—Stephen L. Blau
*Attorney, Agent, or Firm*—Dorsey & Whitney LLP

[57] ABSTRACT

One embodiment of the present invention relates to a system for balancing a set of clubs such that the dynamic moments of inertia, including inertial components attributable to the golfer's arms, are substantially equivalent. A balancing method of the present invention comprises the steps of selecting a user defined reference club, calculating its sensed dynamic moment of inertia, calculating masses for the remaining club heads within the set so that their sensed dynamic moments of inertia are each substantially equivalent to that of the reference club, and utilizing corresponding heads for such remaining clubs.

6 Claims, 4 Drawing Sheets

METHOD FOR BALANCING A SET OF GOLF CLUBS

TECHNICAL FIELD

The present invention relates to golf clubs. More particularly, the present invention relates to a new method for balancing golf clubs within a set.

BACKGROUND OF THE INVENTION

Balancing or weighing a set of golf clubs is a process by which the maker attempts to insure that some property is maintained constant for each club in the set. The purpose is to give each club a constant or regular change in how it feels to the golfer when swung.

The most prevalent system in use is called swing weighting (see, e.g., U.S. Pat. No. 1,953,916). With this balancing method, each club is effectively supported by a pivot at a fixed distance (typically 14 inches) from the butt of the club shaft and a force is applied at twice the distance from the butt end of the shaft to keep the club from rotating about the pivot. The force necessary to do this is kept constant for each club in the set to be balanced. However, the effectiveness of this balancing system is limited because the property being kept constant (the so-called swing weight) does not address the dynamics of a golfer's actual swing.

Subsequent to the introduction of the swing weight balancing method, researchers investigated the dynamic properties of a typical golf swing (see, e.g., T. Sorensen Jr., American Journal of Physics, vol 38-5, p. 644 (1970)). This original analysis, however, was flawed because it assumed constant torque was being applied by the golfer's shoulder throughout the entire swing, which is not physically possible. Rather, the golfer supplies such torque to rotate his/her arms and the club only during that phase of the motion in which the wrists are cocked (the pre-wristbreak swing component). From that point on until impact (the post-wristbreak swing component), the centrifugal force on the club head causes a transference of angular momentum from the arms to the club causing the club to accelerate angularly and the arms to slow down so that at impact, the leading arm and club shaft are essentially in line.

However, the current methods for balancing a set of golf clubs do not take these swing components into account. Corresponding to the pre and post wristbreak swing components, two principal dynamic terms exist, which govern the motion and contribute to the so-called feel of the club as sensed by the golfer. These two terms are the dynamic moment of inertia and the first moment of mass of the club.

The first term, the dynamic moment of inertia, dictates the angular acceleration during the pre-wristbreak swing component (that portion of the swing from the top of the back swing until the golfer's wrists are allowed to break). The golfer senses this dynamic moment of inertia in response to the torque that his/her body exerts onto the arms; it is part of the so-called feel of the club.

The second term (the first moment of mass of the club relative to the same point used to reference the static moment of inertia of the club) affects only the post-wristbreak swing component (that phase after the wrists have been released from the cocked position). The club's static moment of inertia also enters into the equations of motion at this point, but its effect is much smaller than that of the first moment.

An optimally effective balancing method for improving the feel of the clubs should address these two distinct swing components, along with their corresponding dynamic terms. However, present balancing methods fail to incorporate the first moment of mass of the club to address the post-wristbreak swing component. Furthermore, in addressing the pre-wristbreak swing component, present methods, at most, effectuate a dynamic moment of inertia solely attributable to the club and relative to a non-dynamically important axis. Such methods fail to account for dynamic components resulting from the length of the golfer's arms, as well as from the club.

Accordingly, what is needed in the art is an improved method for balancing a set of golf clubs to enhance their associated feel. This method should separately and adequately address both the pre and post wristbreak swing components. In addition, it should account for dynamic terms that are attributable to the golfer's arms, as well as to the clubs.

SUMMARY OF THE INVENTION

One embodiment of the present invention relates to a system for balancing a set of clubs such that the dynamic moments of inertia, including inertial components attributable to the length of the golfer's arms, are substantially equivalent, thereby enabling the golfer to apply a consistent swing for each of the various clubs of the balanced set of clubs.

In this first embodiment, the balancing method of the present invention comprises the steps of selecting a user defined reference club, calculating its sensed dynamic moment of inertia, calculating masses for the remaining club heads within the set so that their sensed dynamic moments of inertia are each substantially equivalent to that of the reference club, and utilizing corresponding heads for such remaining clubs.

Another embodiment of the present invention relates to a system for balancing a set of clubs such that (1) the dynamic moments of inertia, including inertial components attributable to the length of the golfer's arms, are substantially equivalent, and (2) the first moments of mass of each of the clubs are equivalent, thereby enabling a golfer to apply a consistent swing for each of the various clubs of the balanced set and to break his/her wrists at a substantially, same, consistent point within the swing for each of the clubs within the balanced set.

In this embodiment of the present invention, the balancing method comprises the aforementioned steps for the first method, along with the additional steps of calculating the first moment of mass for the reference club and utilizing shafts, grips, and heads for the remaining clubs so that each of their first moments of mass are equivalent to that of the reference club.

For both embodiments, the present invention requires only simple measurements and calculations as a result of approximations that slightly reduce the balancing effectiveness, but which substantially increases the ease and efficiency of the method.

One object of the present invention is to provide a easy method for balancing clubs.

Another object of the present invention is to provide a set of clubs, a set of woods, a set of irons, or both, having the same total dynamic moment of inertia so that each club has a constant or regular change in how it feels to the golfer when swinging.

Another object of the present invention is to provide a set of clubs, a set of woods, a set of irons, or both, having the same first moment of mass so that each club has a constant or regular change in how it feels to the golfer when swinging.

DETAILED DESCRIPTION OF THE PREFERRED EMBODIMENT

Figure 1:
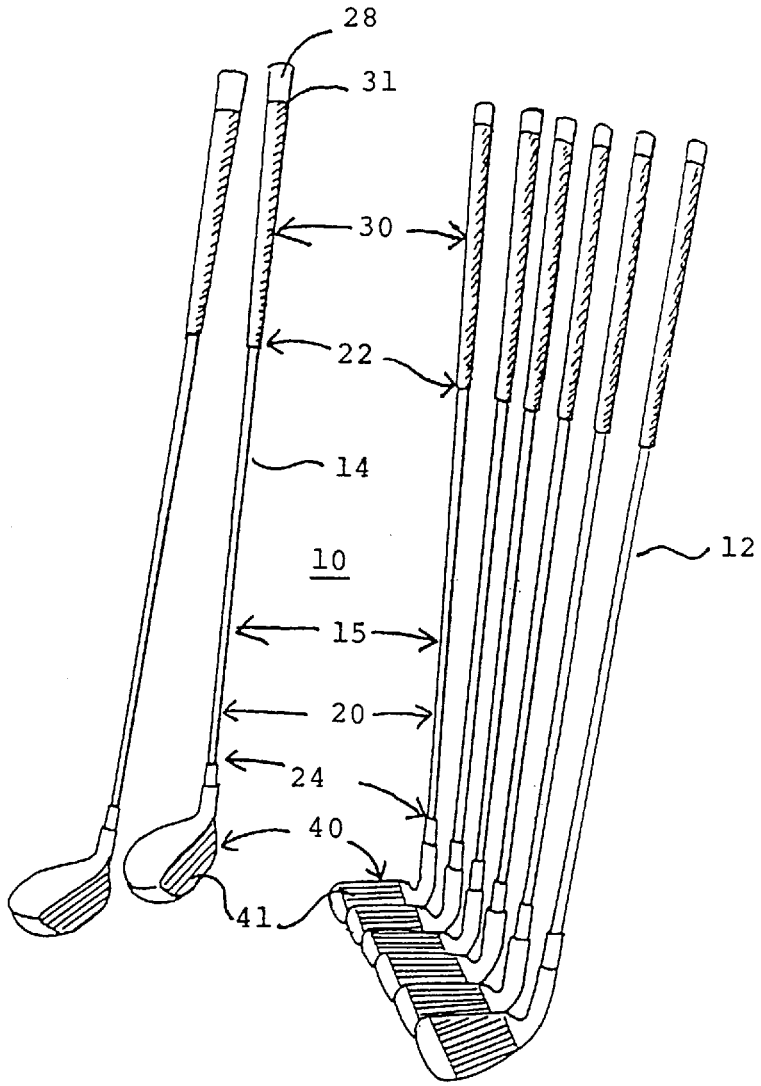
FIG. 1 is a perspective view of a standard set of golf clubs including irons and woods and excluding the putter.
Figure 2A:
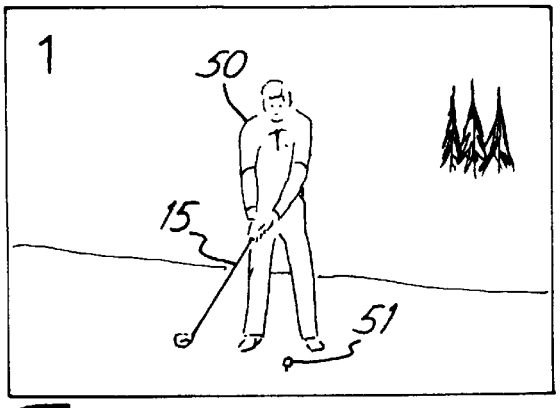
FIGS. 2*a*–2*f* are sequential views in perspective of a golfer in various stages of swinging a golf club.
Figure 2B:
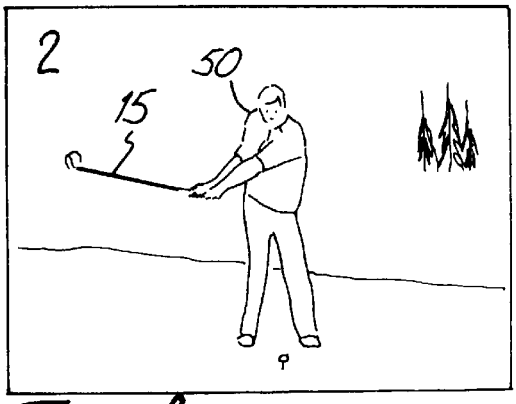
Figure 2C:
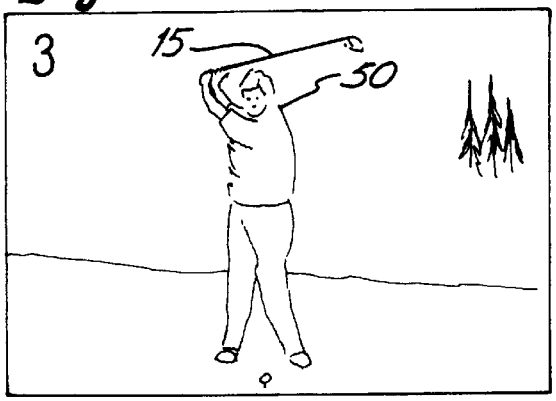
Figure 2D:
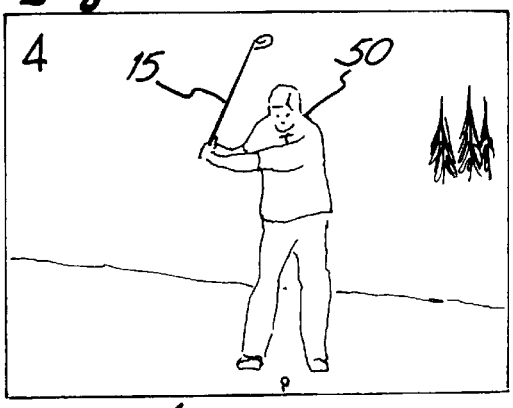
Figure 2E:
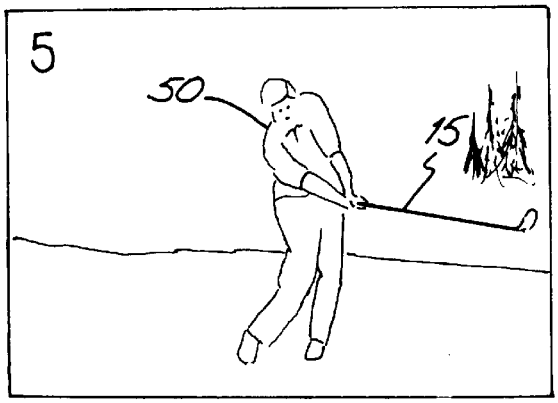
Figure 2F:
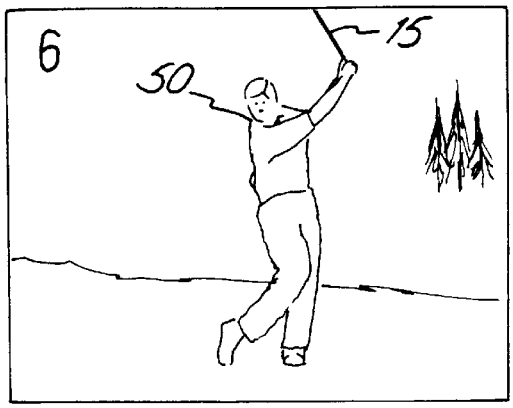

With reference to FIG. 1, a standard golf set 10 includes both a set of irons 12 and a set of woods 14. Each club 15, which can be an iron 12 or a wood 14, comprises a shaft 20 having an upper end 22 and a lower end 24, a grip 30 that is attached to the upper end 22 of the shaft 20 and a head 40 having a ball striking face 41 that is attached to the lower end 24 of the shaft 20.

In general, the present invention relates to a method for balancing a set of golf clubs 10 to enhance their effective "feel". In one embodiment, which will be referred to as the Constant Moment of Inertia method ("CMI Method"), this goal is achieved by equalizing the dynamic moment of inertia (encompassing both a moment attributable to the golfer's arms, as well as to the club 15). In another embodiment, which will be referred to as the CMIJ method, this goal is achieved by equalizing the dynamic moment of inertia (encompassing both a moment attributable to the length of the golfer's arms, as well as to the club 15) and the first moments of mass, of each of the clubs 15 with reference to one another.

Both the CMI and CMIJ methods, which will be discussed in greater detail below, may be applied to a set of clubs which may be defined as a set of woods 14, a set of irons 12, an entire set of clubs 10, or any combination thereof.

Figure 3:
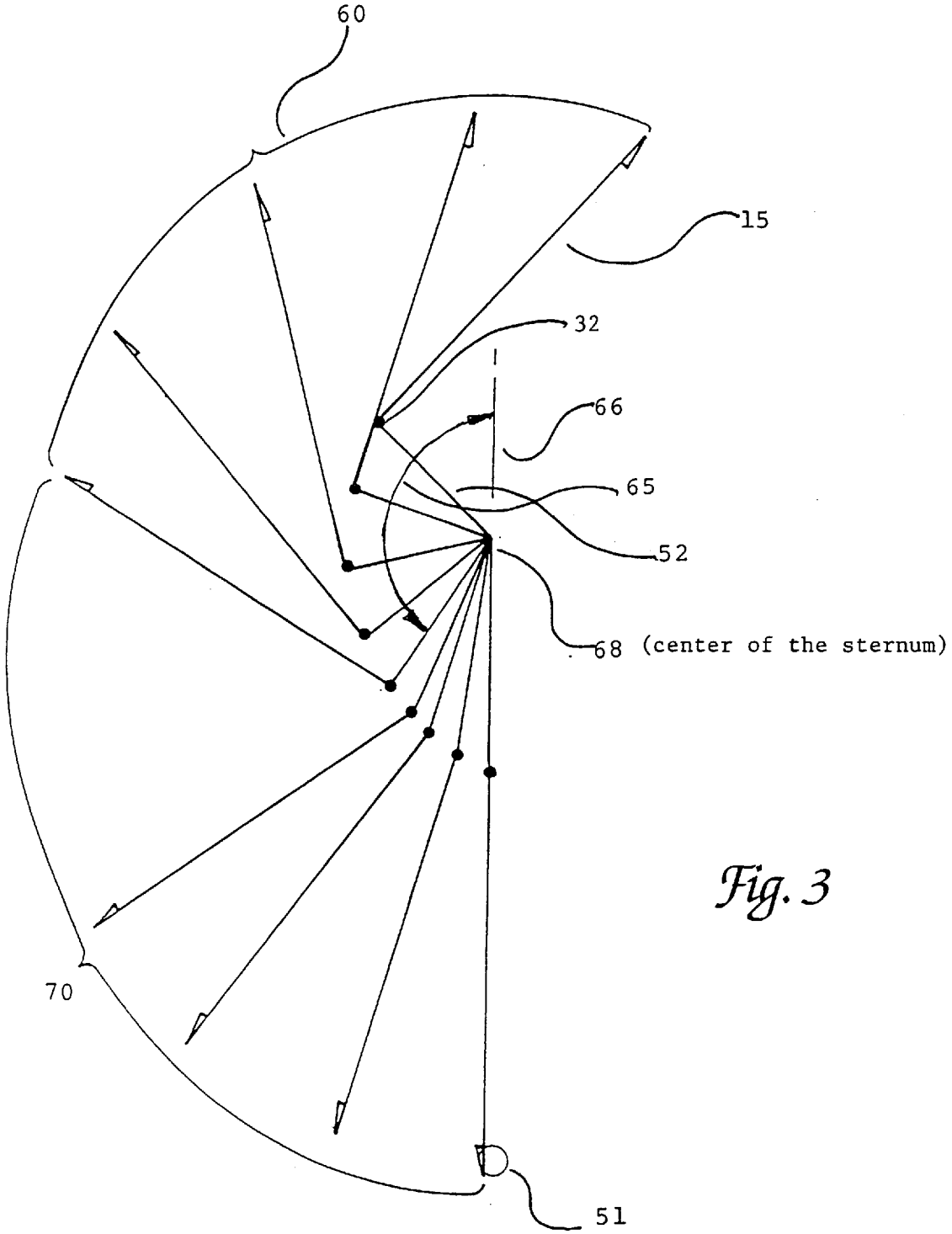
FIG. 3 is a diagrammatic view illustrating a golf swing.
Figure 4:
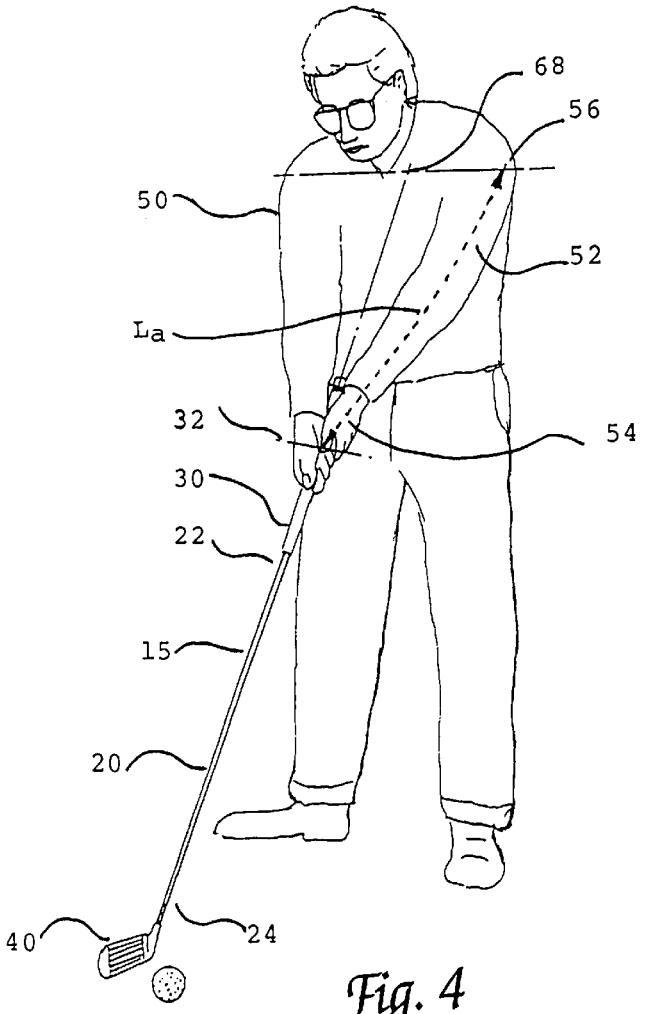
FIG. 4 is a diagrammatic view in perspective of a golfer gripping a golf club in a standard manner.

As depicted in FIGS. 2 and 3, a typical golfer's 50 swing may be dissected into two primary components: a pre-wristbreak component 60 and a post-wristbreak component 70. FIGS. 2*a* and 2*b* illustrate the golfer's 50 initial backswing in preparation to hit the ball 51. FIGS. 2*c* and 2*d* illustrate the pre-wristbreak component, while FIGS. 2*e* and 2*f* present post-wristbreak component views. As more clearly shown in FIG. 3, the pre-wristbreak component 60 begins at the start of the swing and ends when the golfer's wrists begin to break. The break angle 65 is the angle created by the vertical axis 66 and the golfer's upper swing arm 52 (the arm associated with the upper hand 54 on the grip 30, as depicted in FIG. 4). The post-wristbreak component 70 begins at the wristbreak and ends when the club 15 strikes the ball 51.

With regard to balancing a defined set of clubs, each of these two swing components 60 and 70 require different considerations. To enhance the pre-wristbreak swing component 60, the clubs must be initially designed or subsequently modified so that each club's dynamic moment of inertia ($I_d$) about the axis of rotation 68, is equivalent to one another. This scheme is connoted as the Constant Moment of Inertia ("CMI") method for balancing clubs. Utilization of this method enables a golfer 50 to implement the same swing (i.e. apply consistent torque) to achieve equivalent angular acceleration, for each of the clubs 15, thereby increasing the consistency and effectiveness of the swing.

Enhancing the post-wristbreak swing component 70 involves keeping constant the first moment of mass of the club ($J_c$) for each club 15 within the defined set. The first moment of mass is relative to the wrist hinge (i.e., the grip axis 32 FIGS. 3 and 4). This requirement enables the golfer 50 to maintain essentially a constant break angle 65 in association with his/her swing for each of the clubs 15. The use of this technique (for enhancing the post-wristbreak component 70) in connection with the CMI method (for enhancing the pre-wristbreak component 60) is defined as the CMIJ method. The CMIJ method enables the golfer 50 to implement the same swing for both the pre-wristbreak 60 and the post-wristbreak 70 swing components, thereby increasing the consistency and effectiveness of the complete swing.

CMI Method

Again, to implement the CMI method, one must make the dynamic moment of Inertia ($I_d$) for each club 15 in a given set of clubs 10, equivalent to one another. Referring to FIG. 4, to effectively utilize the dynamic moment of inertia, $I_d$, for this purpose, one must consider the upper swing arm 52 (the arm associated with the hand 54 in the upper position of the grip 30), as well as the arm and upper body as well as the club 15, itself. Viewed in this light, $I_d$ is primarily comprised of three components: (1) the moment of inertia attributable to the length of the golfer's arms and moving upper body, $I_a$, (2) the moment of inertia of the club, $I_c$, rotating about the center of grip axis 32, and (3) the dynamic component, $I_{ca}$, sensed by the golfer 50 as a result of the length ($L_a$) of his/her upper swing arm 52 and the mass ($M_c$) of the club 15. The dynamic moment of inertia, $I_d$, is equal to the sum of these components.

$$I_d=I_a+I_c+I_{ca}$$

Therefore, one must make equivalent to one another the sum of $I_a$, $I_c$, and $I_{ca}$ for each club 15 within the given set of clubs 10 to be balanced.

The dynamic term, $I_{ca}$, becomes relevant because of the use of the center grip axis 32 as the axis of rotation with regard to the moment of inertia attributable to the club 15. In essence, the sum of $I_c$ and $I_{ca}$ is the dynamic moment of inertia of the club about the center of rotation 68.

$I_c$ can be set equal to the sum of three basic components: $I_g$ (the moment of inertia resulting from the grip 30), $I_s$ (the moment of inertia resulting from the shaft 20), and $I_h$ (the moment of inertia attributable to the head 40). Likewise, $I_{ca}$ is approximately equal to $M_cL_a^2$ because $L_a$ is equal to the length from the wrist to the sternum but approximated by the length from the wrist to the shoulder. Therefore, $I_d$ can be expressed as $$I_d=I_a+(I_g+I_s+I_h)+M_cL_a^2. \quad \text{[Eq. 1]}$$

With the exception of the length of a player's arms, any or all of these terms can be adjusted to achieve this equivalency. However, a preferred embodiment of this invention proscribes doing so by adjusting the head mass, $M_h$, to make each club's dynamic moment of inertia, $I_d$, equivalent to one another.

With this in mind, $I_h$ can be expressed as $M_hL_{ce}^2$, where $M_h$ is the mass of the club head 40 and $L_{ce}$ is the effective length of the club 15, as will be explained later. Therefore, $I_d$ can be represented as $$I_d=I_a+(I_g+I_s+M_hL_{ce}^2)+M_cL_a^2 \quad \text{[Eq. 2]}$$

but since $M_c=M_g$ (mass of the grip 30)+$M_g$ (mass of the shaft 20)+$M_h$ (mass of the club head 40), $I_d$ may also be represented as:

$$I_d=I_a+(I_g+I_s+M_hL_{ce}^2)+(M_h+M_g+M_s)L_a^2 \quad \text{[Eq. 3]}$$

Again, to implement the CMI method, one must make $I_d$ equivalent for every club 15 within a particularly defined set of clubs. This goal can be achieved by solving for $M_h$, with $I_d$ held constant for every club, and using club heads 40 with corresponding masses. However, if $M_h$ is made the dependent variable in equation 3, the other terms must be either removed, known, measured, or calculated.

To begin with, in making constant $I_d$ for every club, $I_a$ (the moment of inertia attributable to the arms and upper body) can be removed because it is constant for each and every club within any defined set (i.e. $I_a$ wholly depends only upon the golfer and is specifically independent of any club parameter s). Therefore, the dynamic moments of inertia for each club can be made equal simply by making constant the sum of the moments of inertia attributable to the clubs themselves. Let this sum be connoted $I_{dc}$, which can be represented as $$I_{dc}=(I_g+I_s+M_hL_{ce}^2)+(M_h+M_g+M_s)L_a^2. \quad \text{[Eq. 4]}$$

$I_g$ (the moment of inertia of the grip 30), as well as $I_s$ (the moment of inertia of the shaft 20), can be measured or calculated using known methods.

Figure 5:
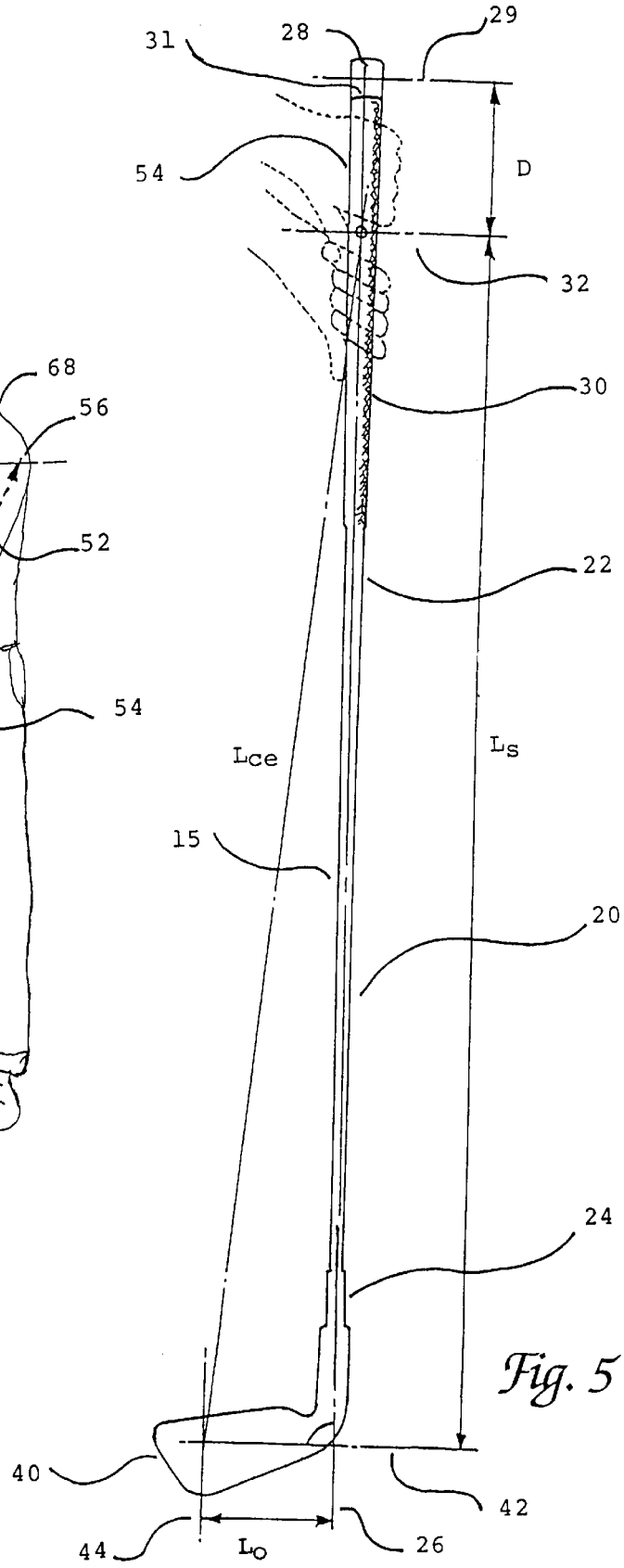
FIG. 5 is a side elevational view of a golf club.

As depicted in FIG. 4, $L_a$, the golfer's upper swing arm length, is the distance from his/her shoulder socket 56 to the center of grip axis 32. With reference to FIG. 5, the effective length of the club, $L_{ce}$, may be calculated. Continuing to refer to FIG. 5, $L_{ce}$ is the hypotenuse of the right triangle that is formed by $L_s$, $L_o$, and $L_{ce}$. $L_s$ is the length of the shaft 20 from the center of grip axis 32 to the vertical center of mass axis 42 of the head 40. $L_o$ is the offset length from the axial center of mass 26 of the shaft S to the horizontal center of mass axis 44 of the head 40. Because these legs form a right triangle, $L_{ce}$ can be represented with the following equation $$L_{ce}=(L_o^2+L_s^2).^{1/2} \quad \text{[Eq. 5]}$$

Therefore, $L_{ce}$ may be calculated from $L_o$ and $L_s$, or it could be directly measured. Note, however, that with little loss of accuracy, one could simply use $L_s$, instead of $L_{ce}$ in the above equations as an effective approximation.

A first step in implementing the CMI method requires that one define a particular set of clubs to be balanced. For example, this set could consist of a standard set of clubs 10 (as is depicted in FIG. 1), it could more narrowly consist of the irons 12 or the woods 14, separately, or any combination thereof. This set is arbitrarily defined based on the subjective preferences of the particular golfer 50.

Next, one must select a reference club from the previously defined set. Any club, such as the driver, for example, may be selected. The next step is to calculate $I_{dc}$ for this reference club by using the terms and equations presented above.

For the reference club, the golfer 50 selects the mass of the head ($M_h$), the shaft 20, the shaft length, and the grip 30. Next, the moment of inertia for the club ($I_c$), the mass of the club ($M_c$), and the product of the mass of the club and the length of the arms squared ($M_cLa^2$) should be calculated or measured. Thus, $$I_{dcref}=I_{cref}+(M_cL_a^2)_{ref}$$

which can be rewritten as $$I_{dcref}=(I_g+I_s+M_hL_{ce})+(M_h+M_g+M_s)^2L_a,$$

where $I_{dcref}$ is the dynamic moment of inertia for the reference club. Because the mass of the head ($M_h$), the shaft 20, and the grip 30 have been selected, $M_h$ (mass of the head 40), $M_g$ (mass of the grip 30), and $M_s$ (mass of the shaft 20) can also be measured for the reference club and because also, $I_g$ (moment of inertia of the grip 30), and $I_s$ (moment of inertia of the shaft 20) can be measured or calculated, based on the golfer's selection of the referenced club, the dynamic moment of inertia for the reference club ($I_{dcref}$) can be determined.

Equation 4 can be written with $I_{dc}$ substituted with $I_{dcref}$ and solved for $M_h$.

$$I_{dcref}=(I_g+I_s+M_hL_{ce}^2)+(M_h+M_g+M_s)L_a^2; \text{ or}$$

$$M_h(L_{ce}^2+L_a^2)=I_{dcref}-(M_g+M_s)L_a^2-I_g-I_s; \text{ or}$$

$$M_h=[I_{dcref}-(M_g+M_s)L_a^2-I_g-I_s]/[(L_{ce}^2+L_a^2)]. \quad \text{[Eq. 6]}$$

Once the dynamic moment of inertia has been calculated for the reference club, this value can be used to determine the mass of the head for the other clubs in the set to be balanced. The length of the shaft will vary depending on the club and indeed the grips and shaft could be different for each club in addition to the normal length change. But all these other parameters required in the equation 6 can be measured or calculated based on the shaft 20 and grip 30 selected for a particular club 15. Thus, using equations, the masses for the heads 40 of the other clubs can be determined by solving for $M_h$ heads 40. Masses corresponding to values resulting from equation 6 would then be utilized for the clubs to be balanced under the CMI system.

CMIJ Method

Referring to FIG. 1, the shaft 20 set of clubs 10 has a butt 31 to which a back mass 28 may be added under the CMIJ method.

Referring to FIGS. 4 and 5, the CMIJ method addresses the post-wristbreak 70, as well as the pre-wristbreak 60, components of a golfer's swing. As previously stated, the post-wristbreak component 70 is substantially improved by equalization of the first moment of mass of the club, for each of the clubs within the defined set, with respect to one another.

Referring to FIG. 5, this equalization can be achieved by varying the mass (and mass distribution) for each shaft 20, by varying the head 40 masses, and/or by adding back-mass 28, where mass is added to the butt 31 of the shaft 20. A combination of any or all of these adjustments may be utilized.

It has been found, however, that an effective means for implementing this method includes varying the mass of the head 40, as well as adding appropriate back-mass 28 to the shaft 20, for each of the clubs to be balanced. Therefore, two independent equations are required to solve for these two variable mass components. These two equations are derived from the dynamic moment of inertia, $I_d$, (as defined in equations 1–4) and the first moment of mass of the club, $J_c$.

However, with the CMIJ method, the dynamic moment of inertia, $I_d$, now consists of the three previously discussed components from the CMI method ($I_a$, $I_c$, and $M_cL_a^2$), along with the moment of inertia ($I_b$) attributable to the added back-mass 28. In addition, the mass of a club, $M_c$, is now the sum of $M_g$, $M_s$, $M_h$, and $M_b$, where $M_b$ is the mass of the added back-mass 28. Thus, $$I_d=I_a+I_c+M_cL_a^2+I_b \quad \text{[Eq. 7]}$$

Again, in equalizing the dynamic moments, $I_a$ may be neglected since it is constant for all clubs, regardless of their dimensions. Therefore, only the dynamic moment component resulting from the club ($I_{dc}=I_c+M_cL_a^2+I_b$) must be considered.

Referring to FIG. 5, the dynamic moment ($I_b$) attributable to the back-mass 28 may be approximated as $M_bD^2$, where $M_b$ is the mass of the back-mass 28 and D is the distance from the center of mass axis 29 of the back-mass 28 to the center of grip axis 32. Therefore, $I_{dc}$ may be represented as $$I_{dc}=M_bD^2+I_g+I_s+M_hL_{ce}^2+(M_g+M_h+M_s+M_b)L_a^2 \quad \text{[Eq. 8]}$$

The first moment of the club, $J_c$, (referenced to wrist hinge 32 FIGS. 3 and 4) is composed of four components: $J_b$ (the first moment attributable to the back-mass 28), $J_g$ (the first moment attributable to the grip 30), $J_s$ (the first moment attributable to the shaft 20), and $J_h$ (the first moment attributable to the head 40). Thus, $$J_c=J_b+J_g+J_s+J_n \quad \text{[Eq. 9]}$$

The first moment of the club is calculated with respect to the center of grip axis 32 because this is the only relevant axis of rotation with regard to the post-wristbreak swing component 70. Relative to this axis (as depicted in FIG. 5), $J_b$ is equal to $-M_bD$. $J_g$ and $J_s$ will be known, calculated, or measured; and $J_h$ is equal to $M_hL_{ce}$. Therefore, the first moment of the club may be expressed as $$J_c=M_hL_{ce}+J_g+J_s-M_bD; \quad \text{[Eq. 10]}$$

To implement the CMIJ method, not only must every club's dynamic moment of inertia, $I_d$, be the same, but also, every club's first moment of mass of the club must be equal to one another. As with the CMI method, a reference club must be selected. Using equation 8, $I_{dc}$ can be calculated for this reference club. Again, $I_s$, $I_g$, $M_sM_n$, $M_g$, and $L_{ce}$ can be measured, calculated or will be known. Also, $M_b$ will be known and in all likelihood will be zero for this reference calculation because the reference club does not need to include a back-mass 28 component.

The next step is to calculate $J_c$ for this same reference club, using equation 10. These values will be substituted for $I_{dc}$ and $J_c$, respectively, in calculating the remaining club back-mass and head mass components. Also, $J_g$ and $J_s$, as with $I_g$ and $I_s$, can be measured or calculated, using methods that are known to those skilled in the art. Therefore, the only unknown parameters, with respect to equations 8 and 10, are $M_h$, $M_b$ and D. However, to efficiently balance a set of clubs with this method, one can use varying back-mass components 28 with standard distances, D. Therefore, for the remaining clubs, $M_h$ can be calculated by algebraically combining equations 8 and 10 to eliminate $M_b$. Once $M_h$ has been determined, $M_b$ can be derived by using either equation 8 or equation 10.

Note that with this embodiment of the invention, after solving for $I_{dc}$ and $J_c$ for the reference club, one is left with two equations (8 and 10) and two unknown parameters, $M_h$ and $M_b$, which represent the balancing components of the clubs. Either $M_h$ or $M_b$ could be initially determined, depending upon how equations 8 and 10 are simplified. However, a preferred method is to initially solve for $M_h$ to insure that this value does not deviate too drastically from the standard or preferred value with regard to any given club. If the value does not fall within an acceptable range, it can be modified by varying the reference parameters (e.g., $I_g$, $I_s$, $M_s$, $M_g$) for the selected reference club and recalculating $M_h$ until a desired value is obtained.

It will be seen by those skilled in the art that various changes may be made without departing from the spirit and scope of the invention. For example, it will be clear that this invention could be implemented in connection with presently available manufacturing techniques for producing statically matched sets of clubs. In addition, the invention could be utilized to balance existing sets of clubs. Accordingly, the invention is not limited to what is shown in the drawings and described in the specification but only as indicated in the following claims.

What is claimed is:

1. A method for balancing a set of golf clubs, each of the clubs having a shaft with an upper end and a lower end, a grip, and a head with a ball-striking face, the head mounted on the lower end of the shaft and the grip mounted on the upper end of the shaft, the pitch of the head increasing through the set and the length of the shaft of each club decreasing through the set as the pitch of each head increases, the method comprising the steps of:

a. selecting a reference club from the set to be balanced;

b. calculating a dynamic moment of inertia for the reference club, the dynamic moment of inertia including a component with relation to a center of grip axis and a component with relation to a golfer's axis of rotation;

c. calculating appropriate parameters for the shafts, grips and heads of the remaining clubs within the set to be balanced so that their dynamic moments of inertia, which include a component with relation to the center of grip axis and a component with relation to the golfer's axis of rotation, are all substantially equivalent to that of the reference club; and d. calculating a first moment of mass of the reference club relative to the center of grip axis.

2. The method as defined in claim 1 further comprising the step of calculating appropriate parameters for the shafts, grips and heads of the remaining clubs so that each club's first moment of mass in relation to the center of grip axis is substantially equivalent to that of the reference club.

3. The method as defined in claim 2 further comprising the step of adding appropriate backmass components having axial lengths to the shafts of the remaining clubs to make their first moments of mass substantially equivalent to that of the reference club.

4. The method as defined in claim 2, wherein the back-mass axial lengths for the remaining clubs are substantially equivalent to one another.

5. The method as defined in claim 1, wherein the parameter to be calculated is the mass for each of the remaining heads.

6. A set of golf clubs comprising a plurality of individual clubs, each club further comprising:

a. a shaft having an axial length, an upper end, and a lower end;

b. a head having a ball-striking face, the head connected to the lower end of the shaft;

c. a grip attached to the upper end of the shaft, with the pitch of the face of the head increasing through the set and the length of the shaft of each club decreasing through the set as the pitch of each club increases;

each club in the set having a substantially equivalent dynamic moment of inertia including a component with relation to the golfer's axis of rotation;

each club in the set having a substantially equivalent moment of mass, wherein the first moment of mass for a reference club is calculated relative to the center of grip axis, so that the resulting set of golf clubs is balanced.

* * * * *